US007307608B2

(12) United States Patent
Stephenson et al.

(10) Patent No.: US 7,307,608 B2
(45) Date of Patent: Dec. 11, 2007

(54) UNIPOLAR DRIVE CHIP FOR CHOLESTERIC LIQUID CRYSTAL DISPLAYS

(75) Inventors: Stanley W. Stephenson, Spencerport, NY (US); David M. Johnson, Rochester, NY (US); Xiang-Dong Mi, Rochester, NY (US)

(73) Assignee: Industrial Technology Research Institute, Taipei (TW)

( * ) Notice: Subject to any disclaimer, the term of this patent is extended or adjusted under 35 U.S.C. 154(b) by 914 days.

(21) Appl. No.: 10/094,070

(22) Filed: Mar. 8, 2002

(65) Prior Publication Data

US 2003/0169221 A1 Sep. 11, 2003

(51) Int. Cl.
*G09G 3/36* (2006.01)

(52) U.S. Cl. ..... 345/87; 345/211; 345/213

(58) Field of Classification Search ..... 345/87, 345/208–210, 211–213; 349/86
See application file for complete search history.

(56) References Cited

U.S. PATENT DOCUMENTS

| | | | | |
|---|---|---|---|---|
| 4,435,047 | A | 3/1984 | Fergason | |
| 4,713,973 | A * | 12/1987 | Woyton | 73/862.628 |
| 5,251,048 | A | 10/1993 | Doane et al. | |
| 5,437,811 | A | 8/1995 | Doane et al. | |
| 5,453,863 | A | 9/1995 | West et al. | |
| 5,503,952 | A | 4/1996 | Suzuki et al. | |
| 5,570,216 | A * | 10/1996 | Lu et al. | 349/175 |
| 5,644,330 | A | 7/1997 | Catchpole et al. | |
| 5,695,682 | A | 12/1997 | Doane et al. | |
| 5,748,277 | A | 5/1998 | Huang et al. | |
| 5,751,257 | A * | 5/1998 | Sutherland | 345/1.2 |
| 6,034,752 | A * | 3/2000 | Khan et al. | 349/74 |
| 6,198,466 | B1 * | 3/2001 | Morich et al. | 345/95 |
| 6,268,840 | B1 * | 7/2001 | Huang | 345/94 |
| 6,278,429 | B1 * | 8/2001 | Ruth et al. | 345/94 |
| 6,326,959 | B1 * | 12/2001 | Tanaka | 345/211 |
| 6,717,561 | B1 * | 4/2004 | Pfeiffer et al. | 345/94 |
| 2002/0186182 | A1 * | 12/2002 | Stephenson et al. | 345/50 |
| 2003/0085863 | A1 * | 5/2003 | Ma | 345/97 |
| 2003/0160912 | A1 * | 8/2003 | Stephenson | 349/86 |

* cited by examiner

*Primary Examiner*—Richard Hjerpe
*Assistant Examiner*—Kimnhung Nguyen
(74) *Attorney, Agent, or Firm*—Akin, Gump, Strauss, Hauer & Feld LLP

(57) ABSTRACT

Apparatus for driving a cholesteric liquid crystal display wherein the display includes cholesteric liquid crystals having a first planar reflective state and a second transparent focal conic state, which is respectively responsive to different applied fields. The apparatus further includes an addressing structure having rows and columns of conductors arranged so that when a column and a row overlap, they define a selectable pixel or segment to be viewable or non-viewable, and a single drive chip responsive to a single input voltage for applying selected voltages to rows and columns of conductors, so that selectable unipolar fields are applied across the cholesteric liquid crystals of the pixels to selectively change the state of the cholesteric liquid crystal.

1 Claim, 7 Drawing Sheets

UNIPOLAR DRIVE CHIP FOR CHOLESTERIC LIQUID CRYSTAL DISPLAYS

CROSS REFERENCE TO RELATED APPLICATION

Reference is made to commonly assigned U.S. patent application Ser. No. 09/379,776, filed Aug. 24, 1999 by Dwight J. Petruchik et al.; U.S. patent application Ser. No. 09/723,389, filed Nov. 28, 2000 by David M. Johnson et al.; and U.S. patent application Ser. No. 09/851,868, filed May 9, 2001 by Stanley W. Stephenson et al.; the disclosures of which are incorporated herein by reference.

FIELD OF THE INVENTION

The present invention relates to electronic drives for cholesteric liquid crystal displays.

BACKGROUND OF THE INVENTION

Currently, information on flat substrates can be displayed using assembled sheets of paper carrying permanent inks or displayed on electronically modulated surfaces such as cathode ray displays or liquid crystal displays. Other sheet materials can carry magnetically written areas to carry ticketing or financial information, however magnetically written data is not visible.

Current flat panel displays use two transparent glass plates as substrates. In a typical embodiment, such as one set forth in U.S. Pat. No. 5,503,952, a set of electrical traces is sputtered in a pattern of parallel lines that form a first set of conductive traces. A second substrate is similarly coated with a set of traces having a transparent conductive coating. Coatings are applied and the surfaces rubbed to orient liquid crystals. The two substrates are spaced apart and the space between the two substrates is filled with a liquid crystal material. Pairs of conductors from either set are selected and energized to alter the optical transmission properties of the liquid crystal material. Such displays are expensive, and currently are limited to applications having long lifetimes.

Fabrication of flexible, electronically written display sheets using conventional nematic liquid crystal materials is disclosed in U.S. Pat. No. 4,435,047. A first sheet has transparent indium-tin-oxide (ITO) conductive areas and a second sheet has electrically conductive inks printed on display areas. The sheets can be thin glass, but in practice have been formed of Mylar polyester. A dispersion of liquid crystal material in a binder is coated on the first sheet, and the second sheet is bonded to the liquid crystal material. Electrical potential is applied to opposing conductive areas to operate on the liquid crystal material and expose display areas. The display uses nematic liquid crystal materials, which ceases to present an image when de-energized. Privacy windows are created from such structures using the scattering properties of polymer dispersed nematic liquid crystals. Polymer dispersed nematic liquid crystals require continuous electrical drive to remain transparent.

U.S. Pat. No. 5,437,811 discloses a light-modulating cell having a chiral nematic liquid crystal in polymeric domains contained by conventional patterned glass substrates. The chiral nematic liquid crystal has the property of being driven between a planar state reflecting a specific visible wavelength of light and a light scattering focal conic state. Chiral nematic material has the capacity of maintaining one of the given states in the absence of an electric field.

In "Liquid Crystal Dispersions", World Science, Singapore, 1995, page 408, Paul Drzaic discusses the electrical drive of cholesteric liquid crystal displays. Drzaic also states on page 29 that "The use of gelatin, however, creates a material that is too conductive for practical use in electrically addressed PDLC systems". Drzaic further states " . . . actual displays require AC signals to prevent electrochemical degradation." Subsequent patents support Drzaic's assumptions. Later patents such as U.S. Pat. Nos. 5,251,048, 5,644,330, and 5,748,277 all require AC fields having a net zero field for matrix cholesteric liquid crystal displays to prevent ionic damage to the display. The cited patents have display structures formed using expensive display structures and processes applicable to long life situations that require AC drive schemes.

The drive schemes require that each element be written using alternating electrical fields that provide a net zero field across the display to prevent ionic migration. AC drives require large numbers of power supplies and large numbers of switching elements per line.

Prior art electrical schemes, such as U.S. Pat. No. 5,644,330, require four power supplies to supply +Vc, −Vc, +VR, −VR and ground. Each line output must switch one of three voltages to each line of a matrix display. Conventional bipolar drive schemes, as disclosed in U.S. Pat. No. 5,748,277, require the use of expensive analog switching elements as found in a Supertex HV204 8-Channel High Voltage Analog Switch. One analog switch is required for each voltage applied to each trace of the display. Such expensive chips prohibit low cost commercialization. Even more complex switching schemes have been proposed which increase the number of power supplies and analog switches and are disclosed in other patents, such as U.S. Pat. No. 5,748,277.

U.S. Pat. No. 5,251,048 by Doane et al., discloses a method for driving a cholesteric liquid crystal display using a single chip HD44780 CMOS dot matrix driver integrated circuit available from Hitachi America, Ltd. of Brisbane, Calif. A current model of that chip is HD66712U of the same company. The chips are used to drive nematic liquid crystal display. The Doane et al. patent discloses a method of using nematic liquid crystal drive chips to drive a chiral nematic (cholesteric) liquid crystal display. The table at the bottom of column 8 in the cited reference shows that for each positive voltage, there is an equal and opposite negative voltage for a bipolar drive. The chip for nematic systems is complex due to the use of a bipolar drive system that is also used for cholesteric displays in the Doane patent. Such drives require multiple drive voltages (V1 to V5) to write a display.

Cholesteric displays use expensive conventional flat panel display processes. Consequently, current state of the art requires bipolar voltage drive schemes for cholesteric displays to prevent ionic damage. The bipolar drives require at least two voltages and two separate semiconductor switching elements for each drive line.

Prior art for driving cholesteric liquid crystal displays has been directed towards matrix displays with large numbers of rows and columns, which require multiple drive chips. Display architecture has been directed towards multiple drive chips and power supplies and control logic. Single chip drive systems require multiple voltages that are switched to create bipolar drive schemes. Such architectures are expensive. Certain display applications require few drive lines to present information. It would be useful to drive a simple cholesteric display with a single drive chip using a simple drive method.

SUMMARY OF THE INVENTION

It is an object of the present invention to provide a drive for low cost cholesteric memory displays generated using coated polymeric dispersed cholesteric liquid crystals which overcome the problems associated with bipolar fields in liquid crystals.

It is another object of the present invention to provide a simpler, lower cost method of driving coated polymer dispersed cholesteric materials on flexible substrates.

These objects are achieved by an apparatus for driving a cholesteric liquid crystal display comprising:

a) the display including cholesteric liquid crystals having a first planar reflective state and a second transparent focal conic state, which is respectively responsive to different applied fields;

b) an addressing structure having rows and columns of conductors arranged so that when a column and a row overlap, they define a Selectable pixel or segment to be viewable or non-viewable; and c) a single drive chip responsive to a single input voltage for applying selected voltages to rows and columns of conductors, so that selectable unipolar fields are applied across the cholesteric liquid crystals of the pixels to selectively change the state of the cholesteric liquid crystal.

The present invention makes use of unipolar drive systems for cholesteric liquid crystal displays that simplifies the drive structure and requires only a single voltage to drive such a display. Moreover, the present invention reduces the number of voltage switching elements and requirement for a complex power supply. It is a feature of the present invention that it requires only a single drive chip and a single power supply to write a display.

DETAILED DESCRIPTION OF THE INVENTION

Figure 1:
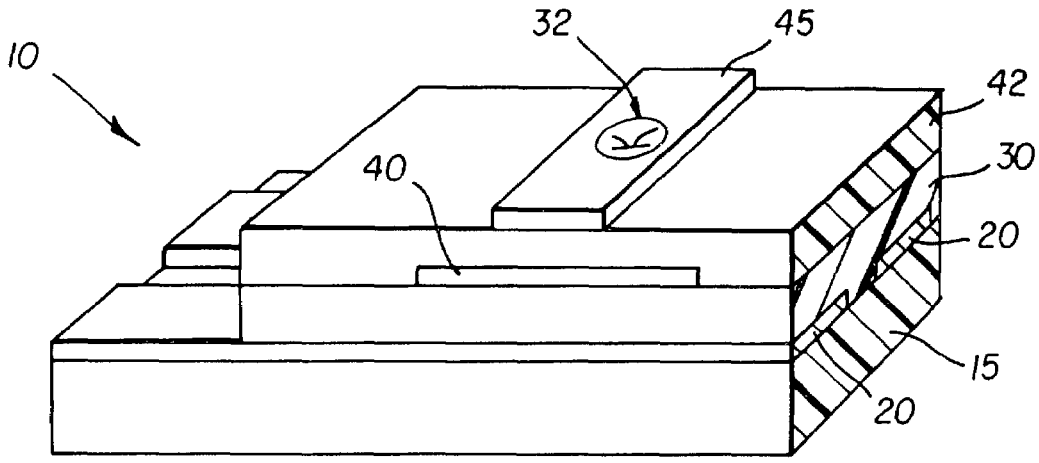
FIG. 1 is an isometric partial view of a cholesteric liquid crystal display made in accordance with the present invention.

FIG. 1 is an isometric partial view of a new structure for a display 10 made in accordance with the invention. Display 10 includes a flexible substrate 15, which is a thin transparent polymeric material, such as Kodak Estar film base formed of polyester plastic that has a thickness of between 20 and 200 microns. In an exemplary embodiment, substrate 15 can be a 125-micron thick sheet of polyester film base. Other polymers, such as transparent polycarbonate, can also be used.

First patterned conductors 20 are formed over substrate 15. First patterned conductors 20 can be tin-oxide or indium-tin-oxide (ITO), with ITO being the preferred material. Typically the material of first patterned conductors 20 is sputtered as a layer over substrate 15 having a resistance of less than 250 ohms per square. The layer is then patterned to form first patterned conductors 20 in any well known manner. Alternatively, first patterned conductors 20 can be an opaque electrical conductor material such as copper, aluminum, or nickel. If first patterned conductors 20 are opaque metal, the metal can be a metal oxide to create light absorbing first patterned conductors 20. First patterned conductors 20 are formed in the conductive layer by conventional lithographic or laser etching means.

A polymer dispersed cholesteric layer 30 overlays first patterned conductors 20. Polymer dispersed cholesteric layer 30 includes a polymeric dispersed cholesteric liquid crystal material, such as those disclosed in U.S. Pat. No. 5,695,682, the disclosure of which is incorporated by reference. Application of electrical fields of various intensity and duration can drive a chiral nematic material (cholesteric) into a reflective state, to a transmissive state, or an intermediate state. These materials have the advantage of maintaining a given state indefinitely after the field is removed. Cholesteric liquid crystal materials are, for example, supplied by Merck BL112, BL118 or BL126, available from E.M. Industries of Hawthorne, N.Y.

In the preferred embodiment, polymer dispersed cholesteric layer 30 is E.M. Industries' cholesteric material BL-118 dispersed in deionized photographic gelatin. The liquid crystal material is dispersed at 8% concentration in a 5% deionized gelatin aqueous solution. The mixture is dispersed to create 10-micron diameter domains of the liquid crystal in aqueous suspension. The material is coated over a patterned ITO polyester sheet to provide a 9-micron thick polymer dispersed cholesteric coating. Other organic binders such as polyvinyl alcohol (PVA) or polyethylene oxide (PEO) can be used. Such compounds are machine coatable on equipment associated with photographic films.

Second patterned conductors 40 overlay polymer dispersed cholesteric layer 30. Second patterned conductors 40 should have sufficient conductivity to carry a field across polymer dispersed cholesteric layer 30. Second patterned conductors 40 can be formed in a vacuum environment using materials such as aluminum, tin, silver, platinum, carbon, tungsten, molybdenum, tin, or indium or combinations thereof. The second patterned conductors 40 are as shown in the form of a deposited layer. Oxides of said metals could be used to darken second patterned conductors 40. The metal material can be excited by energy from resistance heating, cathodic arc, electron beam, sputtering, or magnetron excitation. Tin-oxide or indium-tin oxide coatings permit second patterned conductors 40 to be transparent.

In a preferred embodiment, second patterned conductors 40 are printed conductive ink such as Electrodag 423SS screen printable electrical conductive material from Acheson Corporation. Such printed materials are finely divided graphite particles in a thermoplastic resin. The second patterned conductors 40 are formed using printed inks to reduce cost display. The use of a flexible support for substrate 15, the sputter layer laser etched to form first patterned conductors 20, machine coating polymer dispersed cholesteric layer 30, and printing second patterned conductors 40 permits the fabrication of very low cost memory displays. Small displays formed using these methods can be used as electronically rewritable tags for inexpensive, limited rewrite applications.

A dielectric 42 can be printed over second patterned conductors 40 and has through vias 43 that permit interconnection between second patterned conductors 40 and conductive material that create row lines 45. Row lines 45 can be formed from the same screen printed, electrically conductive material used to form second patterned conductors 40. The connection of sets of second conductors 40 creates functional rows of electrically responsive areas.

Figure 2:
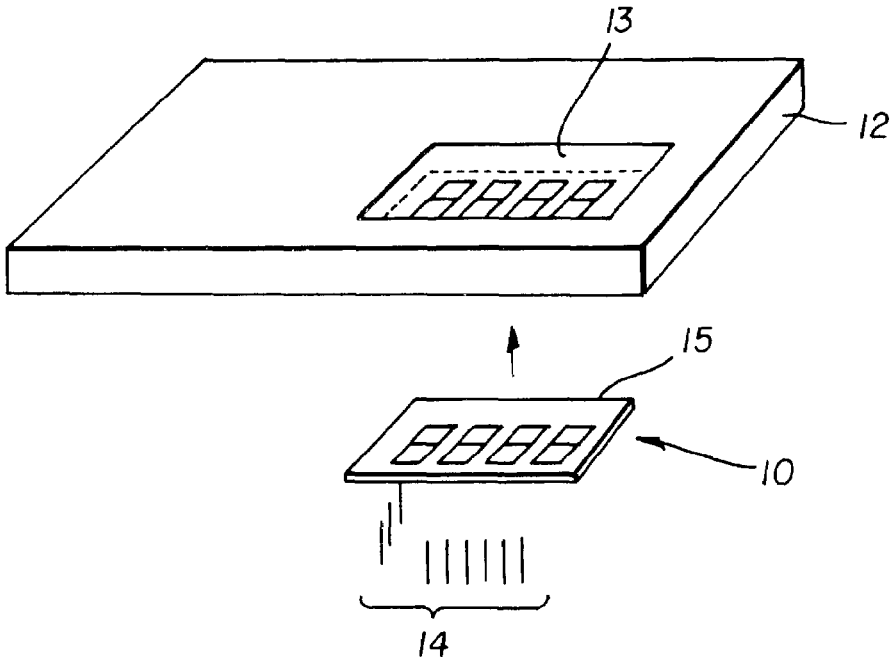
FIG. 2 is an assembly diagram of the display in FIG. 1 being attached to a card.

FIG. 2, an assembly diagram of display 10 in FIG. 1, being attached to a card 12. Card 12 can be a transparent sheet, approximately 0.5 millimeter in thickness which has information printed on one surface. A non-printed area 13 provides a clear window for viewing the contents of display 10, which has been bonded to the opposite side of card 12. Display 10 in this example has a transparent substrate 15, and is inverted from the position shown in FIG. 1 during the attachment process. Information written to display 10 is seen through non-printed area 13 of card 12 and through transparent substrate 15. Alternatively, non-printed area 13 of card 12 can be an opening through an opaque card 12. Card 12 with attached display 10 can be inserted into a holder (not shown) and contacts 14 can connect to first patterned conductors 20 and row lines 45 on display 10 to update information on display 10. Display 10 can be used as a financial transaction (credit/debit) card typically requiring less than 10,000 updated images.

Figure 3:
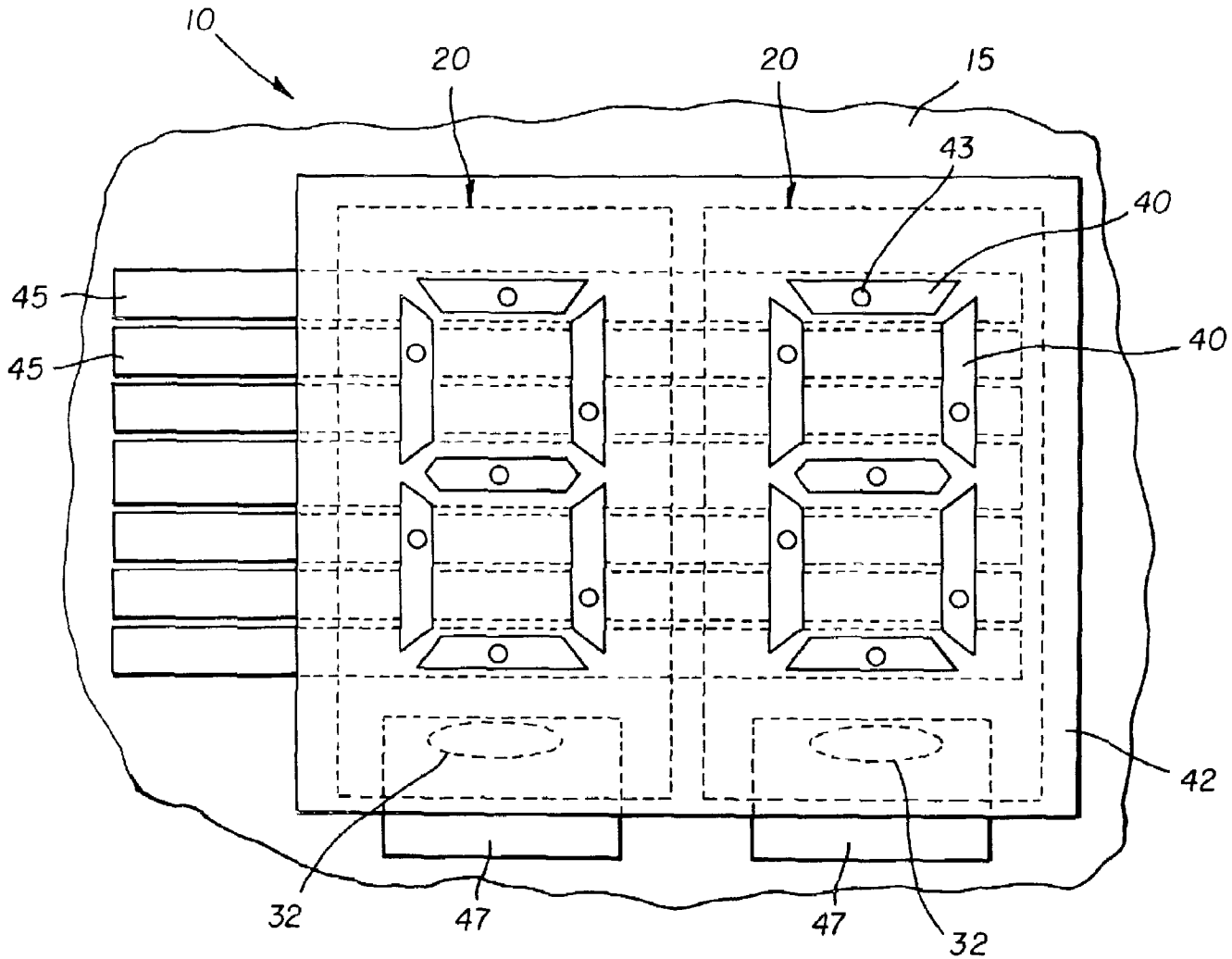
FIG. 3 is a top view of the display of FIG. 1.

FIG. 3 is a front view of display 10 having a matrix addressing structure in accordance with the present invention. Display 10 has two seven-segment characters built so that segments from each character are connected to seven row lines 45 and transparent electrodes in front of each character acting as column lines 47. Looking through substrate 15, first patterned conductors 20 are transparent conductive electrodes over each seven-segment character. Polymer dispersed cholesteric layer 30 is coated behind patterned first conductors 20. A portion of polymer dispersed cholesteric material 30 is removed to form connection area 32 for each column line 47. Second patterned conductors 40 are printed to form the seven segments of each character within the boundaries of first patterned conductor 20. Dielectric 42 is printed across the display and has through via 43 to permit electrical connection of common character segments in each character to row lines 45. A final layer of conductive material is printed across the back of the display to form row lines 45 and column lines 47. Where one of the column 47 and the second patterned conductor 40 connected to row 45 overlap, they define a selectable pixel or segment to be viewable or non-viewable. The completed display is a matrix addressable cholesteric display. Display 10 has seven rows 45 and two columns 47 for each of two characters, and uses less than nine driven lines.

Figure 4:
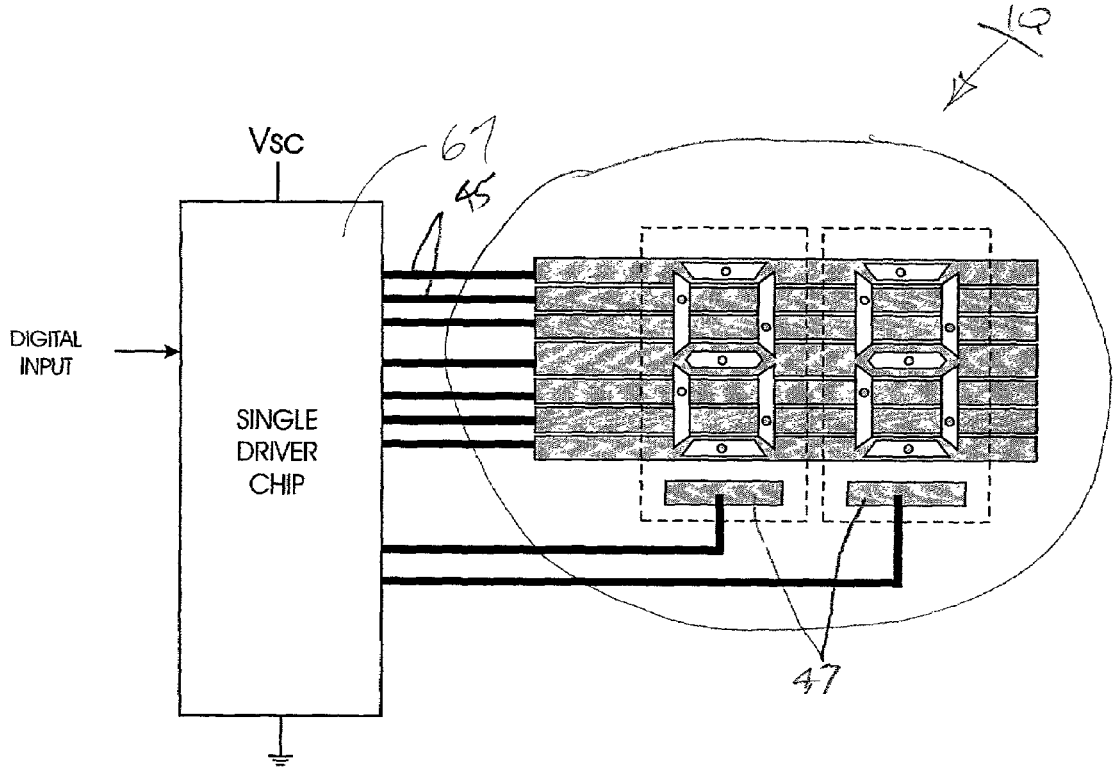
FIG. 4 is a schematic showing the interconnect of a display to a drive chip in accordance with the present invention.

It is advantageous to write to display 10 directly with a single drive chip 67. FIG. 4 is a schematic diagram showing the interconnect of display 10 to drive chip 67 in accordance with the present invention. Display 10 is connected directly to output pins on single drive chip 67 which connect to both row lines 45 and column lines 47.

Figure 5A:
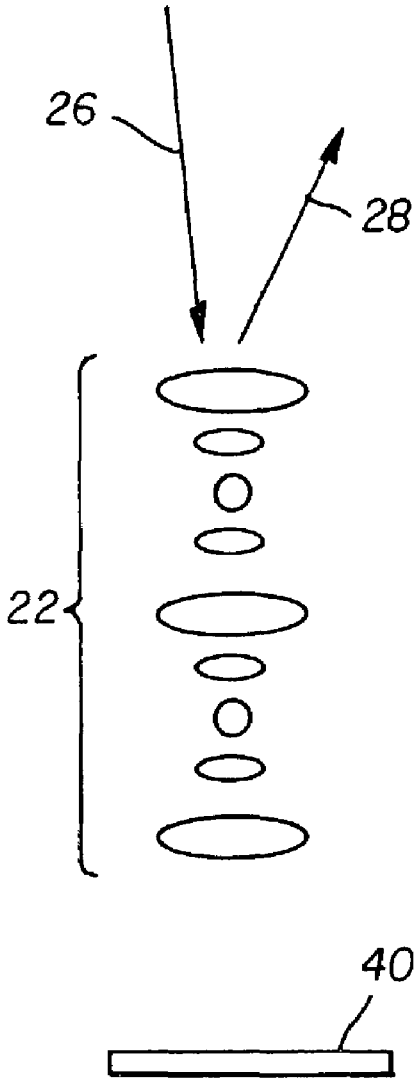
FIG. 5A is a schematic sectional view of a chiral nematic material in a planar state reflecting light.
Figure 5B:
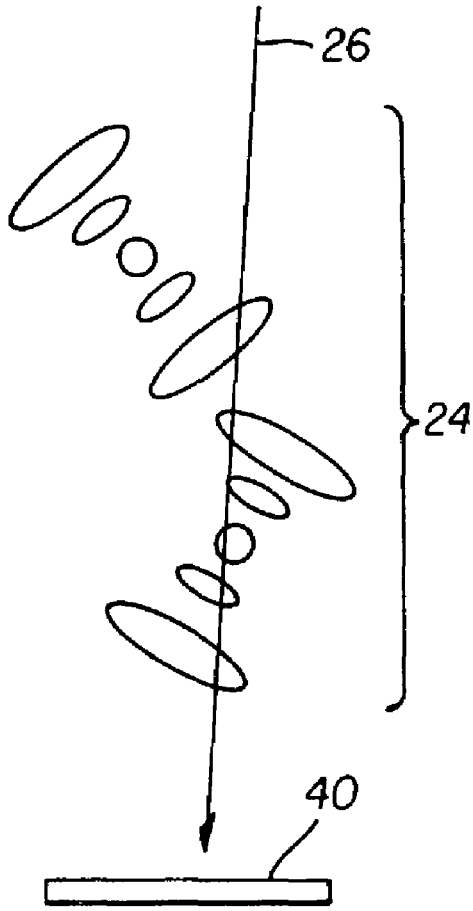
FIG. 5B is a schematic sectional view of a chiral nematic material in a focal conic state transmitting light.

FIG. 5A and FIG. 5B show two stable states of cholesteric liquid crystals. In FIG. 5A, a high voltage field has been applied and quickly switched to zero potential, which converts cholesteric liquid crystal to a planar state 22. Incident light 26 striking cholesteric liquid crystal in planar state 22 is reflected as reflected light 28 to create a bright image. In FIG. 5B, application of a lower voltage field leaves cholesteric liquid crystals in a transparent focal conic state 24. Incident light 26 striking a cholesteric liquid crystal in focal conic state 24 will be transmitted through the cholesteric material. Second patterned conductors 40 can be black which will absorb incident light 26 to create a dark image when the liquid crystal material is in focal conic state 24. As a result, a viewer perceives a bright or dark image depending on if the cholesteric material is in planar state 22 or focal conic state 24, respectively.

Figure 6:
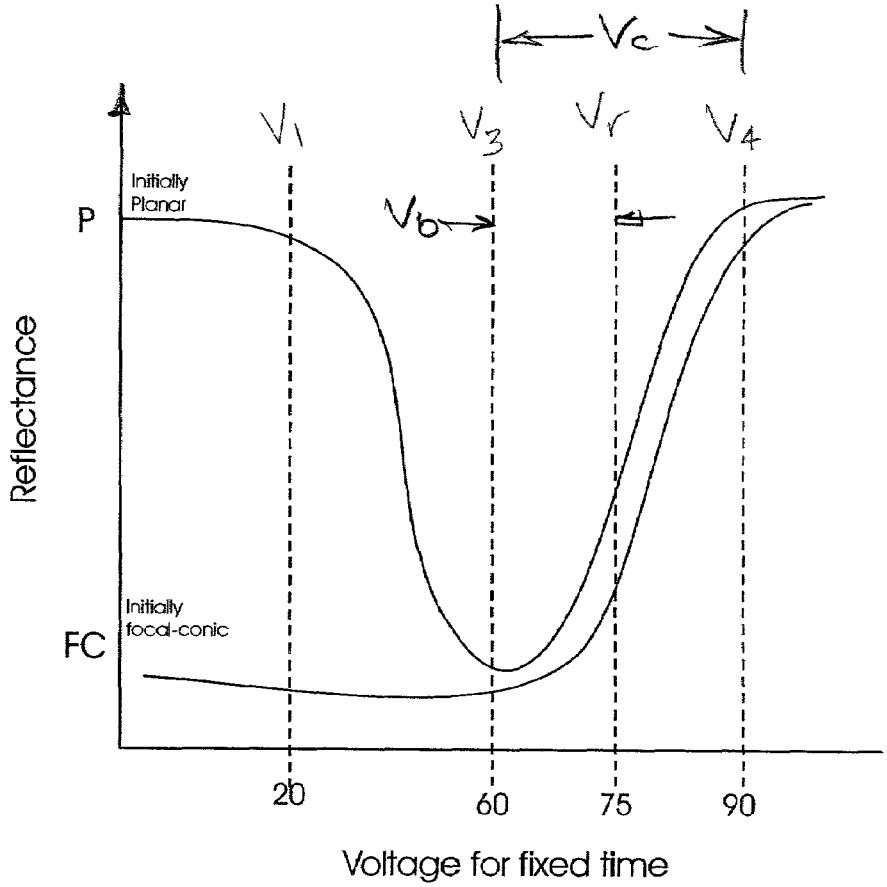
FIG. 6 is a plot of the response of a first polymer dispersed cholesteric material to a series of pulsed electrical fields.

FIG. 6 is a plot of the response of cholesteric material to a pulsed electrical field. Such curves can be found in U.S. Pat. Nos. 5,453,863 and 5,695,682 and are also found in the above-cited Drzaic reference. For a given pulse time, typically between 5 and 200 milliseconds, a pulse at a given voltage can change the optical state of a cholesteric liquid crystal. Disturbance voltage V1 is the highest voltage pulse that can be applied to cholesteric material without changing a written state. Focal conic voltage V3 is a higher voltage pulse that drives cholesteric material into the focal conic state irrespective of the materials initial state. Planar voltage V4 is an even higher voltage that drives cholesteric material into the planar, reflective state irrespective of the cholesteric material's initial state.

Figure 7:
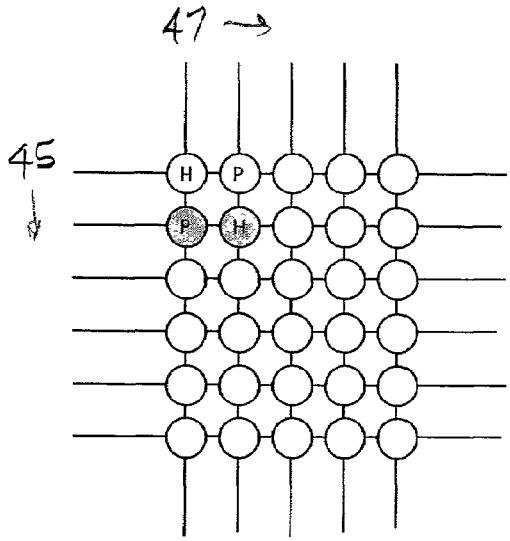
FIG. 7 is a schematic representation of a matrix array of cholesteric liquid crystal elements.

FIG. 7 is a schematic representation of a matrix array of cholesteric liquid crystal elements written using a unipolar drive scheme. Row voltage Vr is set midway between V3 and V4 on a selected row while the remaining rows are set to a ground voltage. Either a positive or negative column voltage Vc is applied to columns 47 in a written row offset Vr to either focal conic voltage V3 or planar voltage V4 on the cholesteric material, depending on the desired final state of a row of pixels. The positive column voltage Vc and negative column voltage −Vc are individually below disturbance voltage V1 so that unwritten rows held at ground potential experience voltages less than disturbance voltage V1 and are not changed. These material characteristics permit sequential row writing.

In an experiment, gelatin dispersed cholesteric material dispersed and coated to the preferred embodiment was coated over ITO coated flexible substrate 15 to form polymer dispersed cholesteric layer 30. A one inch square conductive patch was printed over the gelatin dispersed cholesteric material to create a test display 10. A 20 millisecond unipolar field was switched across the material every 5 seconds to switch the state of the material between the planar and focal conic states. The gelatin dispersed cholesteric material was driven through a limited life test of 10,000 rewrites. The test patch operated with no apparent visible degradation throughout the life test. The life test was then extended to 100,000 cycles. The test display 10 continued to perform with little degradation. From this experiment, it was concluded that polymeric dispersed cholesteric materials on flexible substrates 15 with printed conductors can be intermittently driven by unipolar (DC) fields for the limited number of life cycles needed for limited-life display applications. Such displays in simple seven-segment format benefit from a drive scheme that uses a single drive chip 67. It is of further benefit that single drive chip 67 can use a single chip voltage Vsc.

Figure 8:
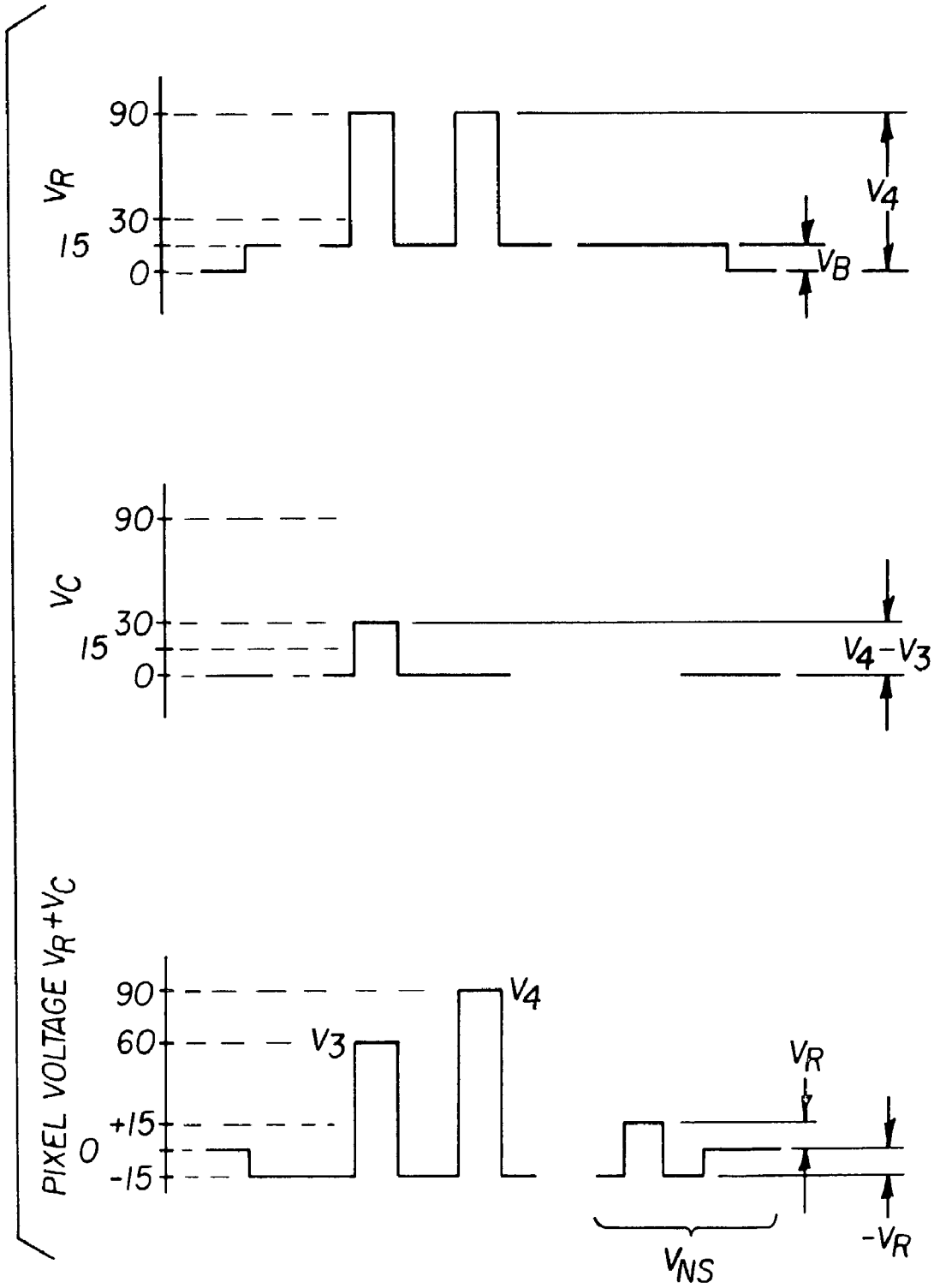
FIG. 8 is an electrical schematic of drive waveforms in accordance with the present invention.

FIG. 8 is a diagram of the waveforms used to write display 10 using the new DC drive scheme. When display 10 is not being written, the voltage supplied to rows and columns are all set to ground (zero) potential. When writing is initiated, drive chip 67 creates a positive 15 volt bias voltage Vb on the row drivers. The bias voltage is set to a potential equal to half the difference in voltage between focal conic voltage V3 and planar voltage V4, which in the exemplary embodiment is 15 volts. During the writing process row lines will receive either 15 or 90 volts. The row being written is set to 90 volts, while the non-written rows are maintained at the 15 volt bias voltage Vb. Single chip voltage Vsc is converted within the chip to a lower column voltage Vc, equal to V4-V3. In the exemplary embodiment column lines are switched between a 30 volt column voltage Vc and ground. Unwritten rows experience half the column voltage because the unwritten rows are held at the bias voltage Vb instead of ground. Unwritten rows experience half the column voltage. The configuration permits sequential writing of a matrix display using DC fields.

A row of data is written by switching row voltage Vr from 15 volts to 90 volts. Column voltages Vc are held at either ground or 30 volts. If column voltage Vc is at 30 volts, cholesteric liquid crystal material experiences a unipolar focal conic voltage V3 and is switched into the focal conic state (FC). If column voltage is at ground state (0 volts), cholesteric liquid crystal experiences a unipolar planar voltage V3 and is switched into the planar state (P). Unwritten rows are held at bias voltage Vb when and experience either −15 and +15 volts from column voltage Vc as rows are written. The 15 volt column voltage is below disturbance voltage V1, and image data in unwritten rows are not disturbed. At the end of writing, all outputs of drive chip 67 are immediately returned to the ground state, and no fields are present on display 10. The method permits sequential row writing of a cholesteric matrix display 10 with very simple unipolar pulses that have a minimum of switched states. The drivers of single drive chip 67 can be simple source-sink semiconductor structures. Such waveforms can be generated directly by simple microprocessors with simple processing algorithms, and do not require complex switching logic required to generate bipolar fields on cholesteric materials.

Figure 9:
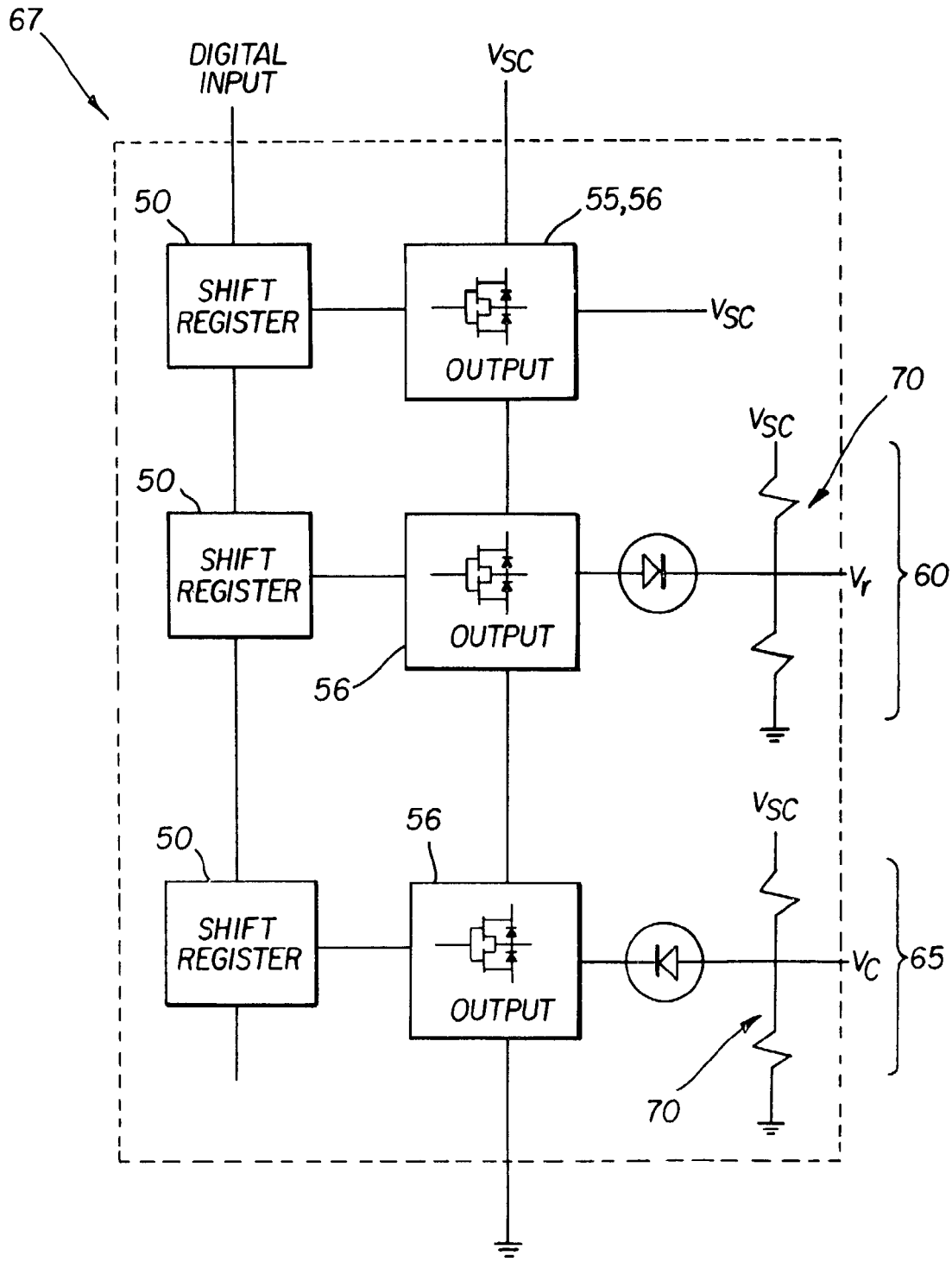
FIG. 9 is a diagram of the internal architecture of a drive chip in accordance with the present embodiment.

FIG. 9 is a diagram of the internal architecture of drive chip 67 in accordance with the present embodiment. Within the drive chip 67, a set of conventional shift registers/latches 50 are sequentially loaded with binary data and are connected to outputs 56 that are in of conventional push-pull CMOS design. A single drive voltage Vsc is applied to drive chip 67. A first output 55 provides single chip voltage Vsc to passive components attached to each output 56. Passive components are resistors and diodes that provide voltage divider network 70 voltages to create appropriate voltages for each row line 45 and each column line 47. When first output 55 is switched off, all outputs 56 are at ground potential. When first output chip 55 supplies single chip voltage Vsc to the other outputs, row voltage outputs switch between 90 or 15 volts, and column voltage outputs switch between 0 and 30 volts due to the voltage divider networks 70 attached to each output. A microprocessor (not shown) sequentially loads shift registers/latches 50 to produce the waveforms shown in FIG. 8 to provide the desired display image. With the unipolar drive scheme, the time between state changes of drive chip 67 is in milliseconds and few state changes are required, permitting a microprocessor to directly control writing of display 10. Single chip 67 provides a simple interface between a microprocessor and display 10. The slow speed and few state changes eliminate complex circuitry found internal to chips using bipolar signals.

The invention has been described in detail with particular reference to certain preferred embodiments thereof, but it will be understood that variations and modifications can be effected within the spirit and scope of the invention.

PARTS LIST

10 display
12 card
13 non-printed area
14 contacts
15 substrate
20 first patterned conductors
22 planar state
24 focal conic state
26 incident light
28 reflected light
30 polymer dispersed cholesteric layer
32 connection area
40 second patterned conductors
42 dielectric
43 through via
45 row lines
47 column lines
50 shift registers/latches
55 first output
56 outputs
67 single drive chip
70 voltage divider network
V1 disturbance voltage
V3 focal conic voltage
V4 planar voltage
Vc column voltage PARTS LIST (con't)

Vr row voltage
Vsc single chip voltage
Vb bias voltage

What is claimed is:

1. Apparatus for driving a cholesteric liquid crystal display comprising:

a) the rewriteable display including cholesteric liquid crystals having a first planar reflective state and a second transparent focal conic state, which are respectively responsive to different applied fields;

b) an addressing structure having rows and columns of conductors arranged so that when a column and a row overlap, they define a selectable pixel or segment of the cholesteric liquid crystals to be viewable or non-viewable; and c) a single drive chip responsive to a single input voltage for applying selected voltages to the rows and columns of conductors, so that selectable unipolar fields are applied across the cholesteric liquid crystals of the pixels to selectively change the state of the cholesteric liquid crystals, wherein said single drive chip includes a voltage divider for providing one of two selectable voltages for each column and one of two selectable voltages for each row; and means for selecting one of two selectable voltages for causing the voltage divider to provide one of two selectable voltages for each column and one of the two selectable voltages for each row so that a voltage for a selectable pixel or segment causes such selectable pixel or segment to be in a transparent focal conic state or planar reflective state.

* * * * *

UNITED STATES PATENT AND TRADEMARK OFFICE

CERTIFICATE OF CORRECTION

PATENT NO. : 7,307,608 B2
APPLICATION NO. : 10/094070
DATED : December 11, 2007
INVENTOR(S) : Stephenson et al.

It is certified that error appears in the above-identified patent and that said Letters Patent is hereby corrected as shown below:

On the Title page:

Item (73) Assignee: Add Industrial Technology Research Institute, Hsinchu (TW)

Signed and Sealed this

Thirtieth Day of December, 2008

JON W. DUDAS
*Director of the United States Patent and Trademark Office*